United States Patent [19]

Fowler

[11] 4,252,138

[45] Feb. 24, 1981

[54] CRUTCH

[76] Inventor: Ivan A. Fowler, 9 Townfield, Kirdford, Billingshurst, West Sussex, England

[21] Appl. No.: 26,871

[22] Filed: Apr. 4, 1979

[51] Int. Cl.[3] ..... A61H 3/02

[52] U.S. Cl. ..... 135/69; 135/71

[58] Field of Search ..... 135/69, 67, 71, 75

[56] References Cited

U.S. PATENT DOCUMENTS

| | | | |
|---|---|---|---|
| 2,474,722 | 6/1949 | Blume | 135/69 |
| 2,674,253 | 4/1954 | Hopkins | 135/69 |
| 2,960,095 | 11/1960 | Smith | 135/69 X |
| 3,738,674 | 6/1973 | Pauls | 135/71 |

FOREIGN PATENT DOCUMENTS

| | | | |
|---|---|---|---|
| 163216 | 6/1949 | Austria | 135/71 |

*Primary Examiner*—J. Karl Bell

*Attorney, Agent, or Firm*—Michael T. Platt; Stanford W. Berman; Irwin M. Aisenberg

[57] ABSTRACT

This invention relates to elbow crutches and provides a crutch to enable a patient with leg disability to raise himself from a sitting position to a standing position. Basically the invention consists in an elbow crutch, the length of which is adjustable under the control of a manually operable lever. In particular, the crutch comprises two telescopically arranged tubular members and a spring urging one tubular member outwardly with respect to the other. A rack and pawl are provided to prevent relative movement between the two members, and the pawl is controlled by the manually operable lever. Normally a patient will use a pair of crutches in accordance with the invention, and will initially operate the lever of each crutch to reduce the length of the crutch to the minimum by pressing the crutch on the floor. He can then raise himself by supporting his weight on the two crutches alternately and operating the control lever of the crutch which is not supporting his weight to allow that crutch to extend.

5 Claims, 2 Drawing Figures

CRUTCH

This invention relates to crutches and it is an object of the invention to provide crutches which can be used by a patient to raise himself to a standing position.

Many patients who have leg disabilities have difficulty in raising themselves from a sitting position to a standing position unless they are able to use their arms to provide the necessary lift. Accordingly, such a patient normally has to receive some form of assistance to enable him to reach the standing position. Such patients frequently have to walk with the aid of crutches and, accordingly, it is a particular object of the present invention to provide crutches which enable a patient to raise himself from the sitting position.

The invention consists in a crutch, the length of which is adjustable under the control of a manually-operable lever, said crutch having a hand grip, and the lever being adjacent to said hand grip.

Preferably the crutch includes a main portion and an extensible end portion. The extensible end portion may be telescopically arranged within the main portion, and spring means are preferably provided to urge the end portion outwardly of the main portion. In this case, the manually-operable lever controls locking means for preventing relative movement between the extensible end portion and the main portion. Thus, when the lever is operated, the end portion may be moved outwardly with respect to the main portion under the influence of the spring, or may be moved into the main portion under the influence of the user's weight.

When a pair of crutches in accordance with the invention is used to enable a patient to raise himself from the sitting position to the standing position, he operates the lever on each crutch to reduce the length of the crutch to the minimum by pressing the crutch on the floor or other ground surface. He then places his arms through the elbow supports and, holding the hand grips, places one crutch on each side of the chair in the vertical position. He then raises himself by supporting his weight with the two crutches alternately, operating the control lever of the crutch which is not supporting his weight, to allow that crutch to extend a short distance under the influence of the spring.

Crutches are already known which comprise a main portion and an extensible end portion. However, such crutches are not capable of being extended while they are in use. Crutches of this kind are designed to be adjustable in length so that they can be used by patients of different heights or having legs of different lengths. To enable the length of such a crutch to be adjusted, it normally has to be lifted from the ground and both hands are required to operate the locking mechanism and change the length of the crutch. If a patient is using a pair of crutches in accordance with the invention, on the other hand, the end portion of one crutch can be driven out from the main portion under the control of the manually-operable lever, while the other crutch is supporting the weight of the patient and, accordingly, a patient can use a pair of crutches in accordance with the invention to raise himself from a sitting position to a standing position.

Means other than a spring may be used for causing the end portion to move outwardly with respect to the main portion. For example, the weight of the end portion may be used to cause this portion to drop out of the main portion, but, since it is normally a requirement that the weight of a crutch should be kept to a minimum, it is considered that the use of a spring is the most advantageous method.

Preferably the locking means for preventing relative movement between the extensible end portion and the main portion include a rack secured to said end portion, and a pawl secured to said main portion. For example, the rack may extend between a clamping member attached to the extensible end portion, and a ring member slidable on the main portion. The pawl may be pivotally mounted on a further clamping member secured to the main portion, and the pawl may be operatively connected to the lever by means of a rod. Spring means are provided to urge the pawl into engagement with the teeth of the rack.

In an alternative construction, the rod is replaced by a flexible cable or the like.

Preferably the teeth of the rack are shaped so that they positively prevent the end portion of the crutch moving outwardly from the main portion as well as moving inwardly into the main portion. However, if desired, the rack may be in the form of a ratchet so that the end portion can move with respect to the main portion without operation of the control lever. With this arrangement, the spring loading on the pawl must be so arranged in relation to the spring loading on the extensible end portion that there is no unintentional extension of the crutch.

It is to be understood that a known form of crutch may be readily converted into a crutch in accordance with the invention by the addition of the manually-operable lever and the locking means for preventing relative movement between the extensible end portion and the main portion. Similarly, if at any time it is desired to use the crutch in the normal manner, the manually-operable lever and the locking means can be removed therefrom.

One method of performing the invention will now be described with reference to the accompanying diagrammatic drawing, in which.

Figure 1:
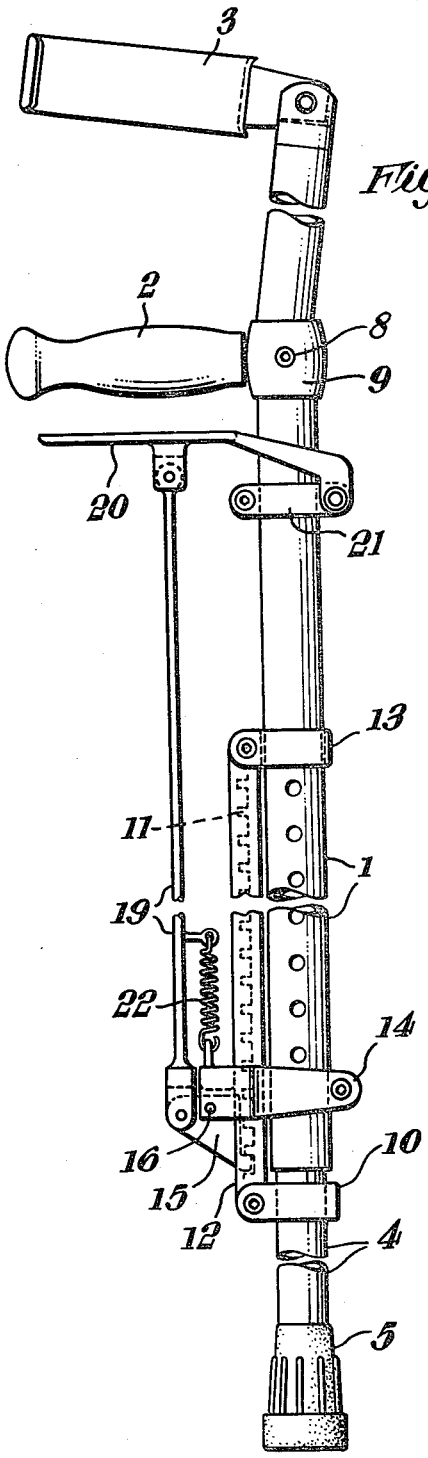
FIG. 1 is a side view of a crutch in accordance with the invention.

The crutch illustrated includes a main tubular member 1, to which is fitted an elbow support 3 and a boss 9 carrying a hand grip 2. A further tubular member 4 is slidable within the tubular member 1, and is provided with a rubber ferrule on the outer end thereof. Both tubular members consist of aluminium or an aluminium alloy, and the tubular member 4 is urged out of the tubular member 1 by means of a steel spring 6, one end of which bears on a plug 7 inserted in the end of the tubular member 4. The other end of the spring 6 bears on a further plug (not shown) in the tubular member 1. This further plug is held in position within the tubular member 1 by means of a pin 8 passing through the boss 9.

A clamp 10 is secured to the tubular member 4 and supports one end of a steel rack 11 enclosed between two steel strips 12. The other ends of the rack 11 and the strips 12 are secured to a ring member 13 which is slidable along the tubular member 1.

A further clamp 14 is secured to the tubular member 1, and a steel pawl 15 is pivotally mounted on the clamp 14 by means of a pivot pin 16. The pawl 15 is provided with a projecting portion 17 adapted to engage the teeth 18 of the rack 11. A stainless steel rod 19 is pivotally attached at one end to the pawl 15 and, at the other end, to an aluminium operating lever 20. The lever 20 is pivotally mounted on the tubular member 1 by means of a clamp member 21. It will be understood that the position of the pawl 15 about its pivot axis is determined by the position of the lever 20, and the rod 19 is urged by a spring 22 in the direction necessary to cause the projecting portion 17 of the pawl 15 to engage the teeth of the rack 11.

Figure 2:
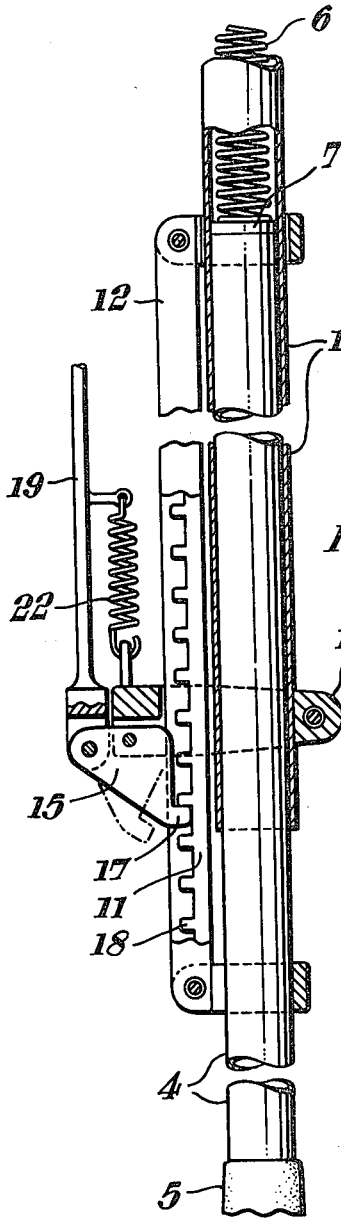
FIG. 2 is an enlarged view, partly in section, of the crutch illustrated in FIG. 1.

Normally the spring 22 will cause engagement between the pawl 15 and the rack 11 so that the tubular member 4 is substantially locked in position in the tubular member 1. However, if the operating lever 20 is moved towards the hand grip 2, the pawl will be moved into the position shown in broken lines in FIG. 2, so that it will be disengaged from the rack and, if no pressure is applied to the crutch, the tubular member 4 will move out of the tubular member 1 under the influence of the spring 6. On the other hand, if pressure is applied to the crutch with the ferrule 5 in engagement with the ground, the tubular member 4 will be moved into the tubular member 1. When the lever 20 is released, the pawl will be returned to the position shown in full-lines in FIG. 2 to limit any further relative movement of the two tubular members.

If desired, the simple rack and pawl mechanism illustrated may be replaced by any of the well-known mechanisms for ensuring that the pawl moves only one tooth along the rack each time the lever 20 is operated.

What is claimed is:

1. A crutch comprising:

(a) a first tubular member;

(b) an elbow support attached to said first tubular member at one end thereof;

(c) a second tubular member slidable within the first tubular member; (d) a first spring urging the second tubular member out of the first tubular member away from said first end thereof;

(e) a hand grip attached to said first tubular member between the ends thereof; and (f) means for permitting the user of the crutch to raise himself from a seated position or lower himself to a seated position by extending or retracting said second tubular member while performing only a single manipulative movement with one hand on the crutch, comprising:

i. a lever pivotally mounted on said first tubular member in the vicinity of said hand grip;

ii. A second spring urging said lever away from said hand grip;

iii. locking means for securing said first and second tubular members in any selected one of a plurality of relative positions; and iv. interconnecting means coupling said lever to said locking means for releasing said locking means when said lever is moved toward said hand grip.

2. A crutch as claimed in claim 1, wherein said locking means comprises:

(a) a member slidable on said first tubular member;

(b) a toothed rack, one end of which is secured to said second tubular member, the other end of said rack being secured to said slidable member; and (c) a pawl pivotally connected to said first tubular member and controlled by said lever to engage and disengage in the teeth of said rack.

3. A crutch as claimed in claim 2, wherein said interconnecting means comprises a rod pivotally connected at one end to said lever, and at the other end to said pawl.

4. A crutch as claimed in claim 3, further including a clamp member for connecting said pawl to said first tubular member and wherein said second spring is a tension spring connected between said rod and said clamp member, and operative to urge said pawl into engagement with the teeth of said rack.

5. A crutch comprising:

(a) a main tubular member;

(b) an elbow support fitted on said main tubular member;

(c) a boss secured to said main tubular member;

(d) a hand grip carried by said boss;

(e) a further tubular member slidable within said main tubular member;

(f) a spring operative to urge said further tubular member out of said main tubular member;

(g) a clamp secured to said further tubular member;

(h) a ring member slidable along said main tubular member;

(i) a toothed rack enclosed between two metal strips, one end of said rack, and of each of said strips, being secured to said clamp, and the other end of said rack and said strips being secured to said ring member;

(j) a further clamp secured to said main tubular member;

(k) a pawl pivotally mounted on said further clamp and provided with a projecting portion adapted to engage the teeth of said rack;

(l) an operating lever pivotally mounted on said main tubular member;

(m) a rod pivotally attached at one end of said pawl and at the other end to said operating lever; and (n) a further spring urging said rod in the direction necessary to cause the projecting portion of the pawl to engage the teeth of the rack.

* * * * *